US006946611B2

(12) United States Patent
Yoneyama

(10) Patent No.: US 6,946,611 B2
(45) Date of Patent: Sep. 20, 2005

(54) KEYBOARD SWITCH WITH INTERNAL FLUID CONTAINMENT NETWORK

(75) Inventor: Masayuki Yoneyama, Fujisawa (JP)

(73) Assignee: Minebea Co., Ltd., Tokyo (JP)

( * ) Notice: Subject to any disclaimer, the term of this patent is extended or adjusted under 35 U.S.C. 154(b) by 101 days.

(21) Appl. No.: 10/872,654

(22) Filed: Jun. 21, 2004

(65) Prior Publication Data

US 2005/0000789 A1 Jan. 6, 2005

(30) Foreign Application Priority Data

Jun. 19, 2003 (JP) ..... 2003-175262

(51) Int. Cl.[7] ..... H01H 13/702
(52) U.S. Cl. ..... 200/515
(58) Field of Search ..... 200/512–517

(56) References Cited

U.S. PATENT DOCUMENTS 4,485,279 A * 11/1984 Nakamura ..... 200/515
4,916,262 A * 4/1990 Jungels-Butler et al. .... 200/515
4,931,601 A * 6/1990 Lavender ..... 200/515
5,561,278 A * 10/1996 Rutten ..... 200/512
5,874,700 A * 2/1999 Hochgesang ..... 200/515
5,986,228 A * 11/1999 Okamoto et al. ..... 200/516
6,441,330 B2 * 8/2002 Liao ..... 200/515
6,491,456 B2 12/2002 Shih et al.
6,664,901 B1 12/2003 Satoru et al.
6,700,086 B2 * 3/2004 Serizawa et al. ..... 200/512
2002/0079210 A1 6/2002 Kawaguchi

FOREIGN PATENT DOCUMENTS

| | | |
|---|---|---|
| JP | 08-255530 | 10/1996 |
| JP | 10-302572 | 11/1998 |
| JP | 09-08-2000 | 9/2000 |
| JP | 2001-100889 | 4/2001 |
| JP | 2001-118458 | 4/2001 |
| JP | 2001-176353 | 6/2001 |
| JP | 2002-170457 | 6/2002 |
| JP | 2002-279854 | 9/2002 |

* cited by examiner

*Primary Examiner*—Michael A. Friedhofer
(74) *Attorney, Agent, or Firm*—Schulte Roth & Zabel LLP

(57) ABSTRACT

A keyboard switch with an internal air escape network, such as a series of channels or through holes, for containing air or fluid escaping from the switching cavities when a key is depressed.

20 Claims, 10 Drawing Sheets

KEYBOARD SWITCH WITH INTERNAL FLUID CONTAINMENT NETWORK

CROSS-REFERENCE TO RELATED APPLICATIONS

This application claims all rights of priority to Japanese Patent Application Serial No. 2003-175262, filed Jun. 19, 2003 (pending).

BACKGROUND OF THE INVENTION

The present invention relates to the switching mechanisms used in keyboards for various electronic devices, particularly personal notebook computers in which the keyboard is disposed above the inner circuitry.

DESCRIPTION OF THE RELATED ART

The conventional mechanisms for converting a key-top pressing motion into a switching action of an electric contact, such as is found in a keyboard switch, generally include two types. The first utilizes a rubber cap connected to the key top, where the rubber cap is typically in the shape of an edgeless hat or cup. The second type utilizes a dome-like spring body serving as the key top. Additionally, either type of the described conventional types of keyboard switches may come in two distinct varieties. In the first, the contact system includes a membrane switch in which the upper and lower contacts are disposed opposite each other and separated by a spacer. In the second, a pair of fixed contacts provided on a substrate are bridged with a movable contact provided on the back side surface of the rubber cap or dome-like spring body. In these conventional examples of the keyboard switch, when the rubber cap or dome-like spring body is buckled or inverted by a key-top pressing motion, the air or other fluid inside the rubber cap or dome-like spring body is rapidly compressed. Such compression creates a counter force against the key-top pressing motion, thereby eventually creating chattering or bouncing of the contacts.

Several solutions to the above identified problems were previously suggested in the industry. For example, it was suggested to link the inner space of the rubber cap of dome-like spring body with the atmosphere. Additionally, it was suggested to form inside the keyboard switch a space for air reservoir which communicates with the inner space of the rubber cap of the dome-like spring body. An example of a key switch having an air vent equivalent portion linking the inside of the rubber cap with the atmosphere is shown in Japanese Published Unexamined Patent Application 2001-100889 and Japanese Published Unexamined Patent Application H08-255530. An example of a key switch having a through hole, provided in a substrate having a pair of fixed contacts, and the inner space of the rubber cap (covering the pair of fixed contacts) communicating with the atmosphere directly behind the back surface of the substrate via the through hole is shown in Japanese Published Unexamined Patent Application 2000-243179.

In above examples of the improved key switch structure, however, dust or water drops can penetrate from the upper surface of the keyboard into the inner space of the dome-like spring members or rubber caps accommodating electrodes therein. Therefore, though the configurations of these examples are effective in terms of adjusting pressure variations in the inner space, the electrodes are exposed to dust or water drops.

FIG. 8 illustrates the configuration of a conventional dome switch (keyboard switch) 201. A surface sheet 202 is provided with a movable electrode in the inner head portion (not shown in the figure) and with a plurality of projecting portions 207 having dome-like spring bodies. A spacer sheet 203, positioned below the surface sheet 202, includes a plurality of through holes 209 positioned correspondingly to the projecting portions 207 and slit-like air escape portions 210 connecting all through holes 209. A flexible printed circuit (FPC) 204 located below the spacer sheet 203 is provided with a fixed electrode 211, wiring, and an air escape opening 206. A laminated adhesive sheet 205 is positioned below the FPC 204 and is provided with an air escape opening 212. Air escape portions 210 and air escape openings 206 and 212 are linked together such that air escape portions 210 are open to the space below the adhesive sheet 205. In this example, if a projecting portion 207 is inverted toward the FPC 204 by a push-down action, the air located inside the projecting portion 207 escapes to the space below the adhesive sheet 205 through the air escape portion 210 via the through hole 209 (see Japanese Published Unexamined Patent Application No. 2002-170457).

In this conventional example, as shown in FIG. 8, an air escape structure includes through holes 209, connected to the air escape opening 206 of the FPC 204 via the air escape portion 210, and the air escape opening 212 of the adhesive sheet 205. However, because the capacity of the air escape portion 210 is not sufficiently large, the air escape opening 206 is provided so as to match the size of the air escape portion 210, and the air escape orifice 212 is provided so as to match the size of the air escape orifice 206, the air located inside the projecting portions cannot move smoothly during push-down action of the projecting portions 207. Particularly, when a plurality of projecting portions 207 are pushed down at the same time, the capacity of the air escape path is insufficient thus preventing adequate air escape. As a result, an undesirable effect on user's fingers can be produced during push-down action of the projecting portions 207.

FIG. 9 illustrates the configuration of a conventional keyboard switch using a rubber cap. An electrically insulating sheet 130 includes a holding plate 160 with a plurality of openings 160*a* and key tops 150 installed in the opening 160*a*. Fixed electrodes 132, 133 and wiring are provided on the surface of the insulating sheet 130. Through openings 130*f* are provided in the vicinity of fixed electrodes 132, 133. Rubber caps 140 are pasted onto the insulating sheet 103 such that each rubber cap covers a pair of fixed electrodes 132, 133 and an opening 130*f*. Each rubber cap 140 is provided with movable electrodes (not shown in the figures) positioned on the inner surface of the top portion. The electrically insulating sheet 130 is laminated with a spacer sheet 120, provided with a plurality of elongated holes 122 opposing the rows of rubber caps 140 and having the same width as rubber caps 140, and a base plate 110. Openings 130*f* and elongated holes 122 are thus linked together. When the rubber cap 140 is pushed down by the push-down action of the key top 150, the air located inside the rubber cap 140 is released into the elongated hole 122 via the opening 130*f* and absorbed in the space of the elongated hole 122. (See Japanese Published Unexamined Patent Application No. 2002-279854).

As shown in FIG. 9, the capacity of the elongated hole 122 is sufficient to accommodate the air located inside one rubber cap 140. However, the drawback of such a configuration is that when a plurality of key tops 150 are pushed down at the same time, the quantity of air that is moved by such a push-down action cannot be contained within the elongated holes. Thus, when a plurality of key tops 150 are pushed down at the same time, the air located inside this plurality of key tops 150 is discharged into elongated holes 122 via openings 130*f* and is partially accommodated within the inner space of elongated holes 122. The air that is not accommodated is released from elongated holes 122 to the outside via individual ventilation holes 130*g*. Ventilation holes 130*g* are formed as through holes in the vicinity of the outer side of rubber caps 140 in the electrically insulating sheet 130 and are linked to the elongated holes 122. Thus, the inner space of rubber caps 140 is eventually linked to the outside space via the ventilation holes 130*g* and a completely sealed state of the key switch cannot be maintained. Moreover, the volume of air allowed to escape is limited by the small size of ventilation holes 130*g* reducing the flow rate of air and adversely affecting the process of keying on this keyboard.

Further, in the example described above with respect to FIG. 9, ventilation openings 130*f* located inside rubber caps 140 are linked to the elongated hole 122 having a linear shape corresponding to the arrangement of key tops 150. Therefore, only linear arrangement of the key tops, shown in FIG. 11(*a*), can be provided with the air escape structure described in FIG. 9, and non-linear key arrangements shown in FIGS. 11(*b*)–11(*d*) cannot be used.

FIG. 11 illustrates the conventional key arrangement. FIG. 11(*b*) shows a cellular telephone comprising a keyboard for hand-held devices. In this example, the keys are arranged in three arcs drawn around an imaginary center located close to the origin point P corresponding to the base of the finger used to operate the keys (see Japanese Published Unexamined Patent Application No. H10-243075). FIG. 11(*c*) is a character input unit having a key arrangement with irregular disposition of the keys which is different from the linear disposition, shown in FIG. 11(*a*) (see Japanese Published Unexamined Patent Application No. H08-137592). FIG. 11(*d*) is an example showing a keyboard unit in which all keys are separated into the left and right groups and disposed so as to obtain a V-shape configuration. In this case, twisting of the hands or arms of the operator during keying is reduced and key operability is improved (see Japanese Published Unexamined Patent Application No. H11-085355). A similar key arrangement is well known in keyboards employing an ergonomic design. Non-linear key-arrangements shown in FIGS. 11(*b*)–11(*d*) cannot be utilized with the linear air escape structure shown in FIG. 9.

FIG. 10 illustrates the configuration of a conventional membrane-type keyboard switch. The membrane keyboard switch shown in FIG. 10(*a*) is the water- and dust-resistant structure in which no openings are provided in the upper surface, although the caps do not protrude as in the example shown in FIG. 8. During the push-down action the air is located below the operational portion of the switch. Particularly, the spacer (also called a support) structure, supporting the upper sheet having electrodes and wiring, has an air release configuration similar to the conventional examples shown in FIGS. 8 and 9.

The membrane keyboard switch has a three-layer structure of an upper sheet 301, a lower sheet 302, and a bracket 303. An upper electrode 304 and an upper spacer 306 having a small surface area are arranged on the lower surface of the upper sheet 301 such that the upper spacer surrounds the upper electrode 304. An annular opening is provided in the upper spacer 306 so as to form a substantially circular upper switch space 308 around the round upper electrode 304. A narrow upper air release channel 312, shown in FIG. 10(*b*), is formed in the substantially circular upper switch space 308, and an upper air collecting space 310 having a large capacity is provided at the head of the upper air release channel 312. A lower electrode 305 and a lower spacer 307, that is partially different from the lower spacer 307 only in two sections, are arranged such that the lower spacer 307 surrounds the lower electrode 305 on the upper surface of the lower sheet 302 (as shown in FIG. 10(*a*)).

In the lower spacer 307, an annular opening is provided so as to form a substantially circular lower switch space 309 surrounding the round lower electrode 305. A lower air collecting space 311, shown in FIG. 10(*b*), corresponding to the aforesaid upper air collecting space 310, is provided at a certain distance away from the annular opening, and a narrow lower air release channel 313 is formed in the lower air collecting space 311. The upper air release channel 312 and lower air release channel 313 are provided in positions facing the upper and lower air collecting spaces 310, 311 having the same shape. Sheets 301 and 302 are positioned such that the two spacers 306, 307 are joined while facing each other.

With the configuration shown in FIGS. 10(*b*), 10(*c*), and 10(*d*), a linking channel is formed between the lower switch space 309, the upper switch space 308, the upper air release channel 312, the upper air collecting space 310, the lower air collecting space 311, the lower air release channel 313, and, finally, the outside space 317. In this example, because the upper and lower air release channels 312 and 313 have a small width and are provided separately above and below at the two ends of the air collecting spaces 310 and 311, the air flow rate can be suppressed and the flow rate can be further reduced by the air collecting spaces, allowing dust that was admixed to the outer air to precipitate in the air collecting spaces 310 and 311.

In the example shown in FIG. 10, it is structurally self-evident that a configuration in which air escape portions or openings are provided in a sheet of flexible printed substrate comprising fixed electrodes and wiring cannot be employed. Problems associated with the structure described in this example are listed below. The structure facilitates a simple push-down action without a clicking action or a buckling action resulting in comparatively slow air movement during the action, incapacitating a rapid movement of the air in the course of the clicking or buckling action (such as described with respect to examples shown in FIGS. 8 and 9 above). Employment of this conventional structure decreases the flow rate of the air moving from the switch spaces 308 and 309 to the external portion 317, thus causing the stagnation of the air and making it inapplicable for executing the clicking or buckling action for which the air has to flow rapidly without a delay. Moreover, because the above-described linking channel has a complex structure, which is divided into the upper and lower spaces, the upper and lower spaces cannot be composed as one general space or support.

SUMMARY OF THE INVENTION

It is an object of the present invention to resolve the above-described problems and to provide a keyboard switch in which a key arrangement can be other than a linear one, the structure is sealed, and fluctuations of the inner space of the protruding member occurring during operation are released inside the keyboard switch, while the operation feel is improved.

The present invention provides a switching mechanism for use in keyboards for electronic devices that achieves an improved user feel over the prior art. The invention is carried out by providing a through hole in strategic locations of the mechanisms supporting the key switch so that air or other fluid contained in the space collapsed by operation of the key can escape smoothly either into other containment chambers or to the outside atmosphere. Less bucking, clicking and bouncing of the keys is produced by providing an air (or fluid) intake reservoir within the switch, along with a through hole or other channel network to connect the fluid reservoirs of adjoining switches, either with or without connecting to the outside atmosphere. The invention contemplates at least three embodiments—one involving a conventional keyboard switch utilizing a rubber cap, and another involving a conventional membrane switch utilizing a dome-like spring body. A third embodiment contemplates use of the aforesaid conventional membrane switch utilizing a dome-like spring body, along with a containment mechanism which prevents the air or fluid from escaping to the outside atmosphere. The third embodiment permits an air-tight membrane keyboard with all of the benefits of the disclosed invention.

The above aspects, advantages and features are of representative embodiments only. It should be understood that they are not to be considered limitations on the invention as defined by the claims. Additional features and advantages of the invention will become apparent in the following description, from the drawings, and from the claims.

BRIEF DESCRIPTION OF DRAWINGS

The invention is illustrated by way of example and not limitation and the figures of the accompanying drawings in which like references denote like or corresponding parts, and in which.

DETAILED DESCRIPTION OF THE INVENTION

Figure 1:
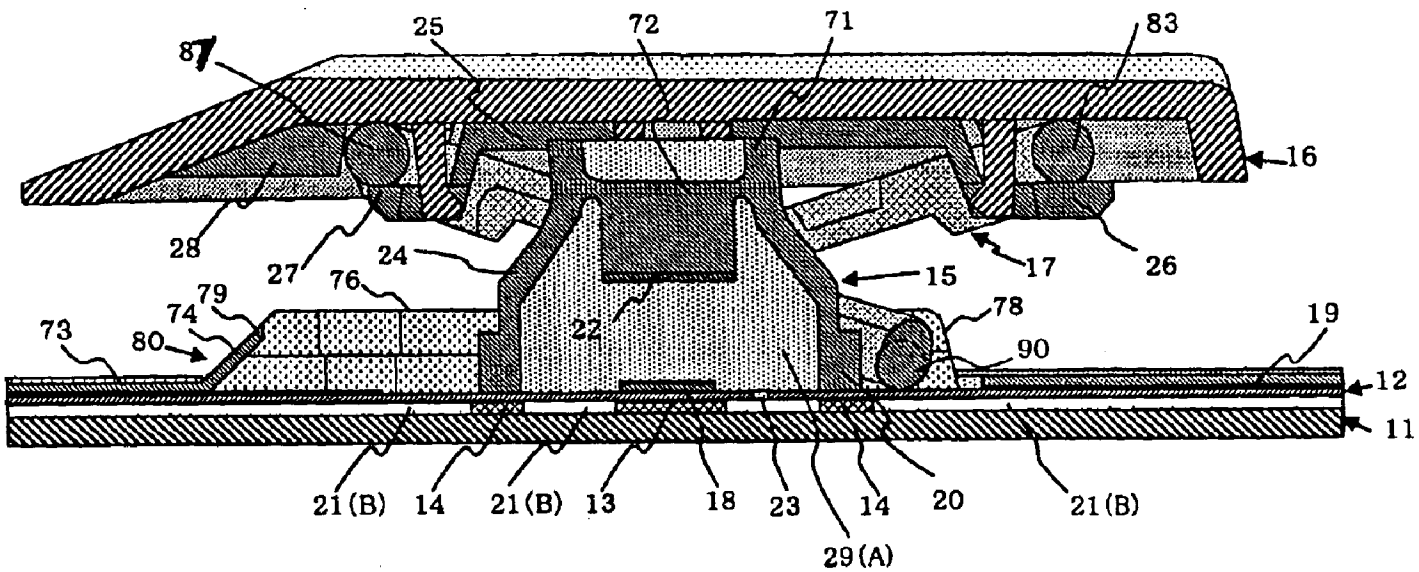
FIG. 1 provides side-view cutaway of the invention as incorporated into a conventional keyboard switch with a rubber cap.

In accordance with the first embodiment of the present invention, the keyboard switch includes a rubber cap used as the protruding member, i.e., the collapsible and re-formable physical apparatus used to separate the electrical contacts which make up the switch. FIG. 1 provides a cross-sectional view of the keyboard switch in accordance with the first embodiment of the present invention. The invention as incorporated into a conventional keyboard switch is illustrated. The keyboard switch includes a flat base plate 11 composed of a metal such as aluminum, a fixed electrode support 13, a rubber cap support 14 placed onto the base plate 11, a membrane sheet 12 arranged above the two supports 13 and 14, a rubber cap (or elastic cap) 15 mounted on the membrane sheet 12, a sheet-like holder 80 secured onto the membrane sheet 12 and having a rectangular opening for loosely inserting the rubber cap, a key top 16 driven by pushing down the rubber cap 15, and a guiding and supporting mechanism 17 of an approximately X-like shape supporting the key top 16. The lower portion of the supporting mechanism 17 is mounted on the sheet-like holder 80, and its arms are pivotally connected to each other in their approximate center so as to conduct guidance for the vertical movement of the key top.

The membrane sheet 12 is a flexible printed circuit (FPC) formed by screen printing, or by some other similar process, to create, an electrically conductive pattern of fixed electrodes 18 and wiring 19 consisting of an electrically conductive ink placed on a transparent base sheet having electrically insulating properties and composed of a resin film such as a polyester film. The electrically conductive pattern can be of a variety of shapes according to the entire shape and specification of the keyboard switch. The pattern is essentially made up of pairs of fixed electrodes of a variety of shapes and a wiring pattern connected thereto. If desired, wiring 19, excluding the fixed electrodes 18, may be covered with a resistant film (not illustrated) to prevent the electrically conductive pattern from being peeled off or broken by friction when the membrane sheet is stacked in the switch.

Figure 2:
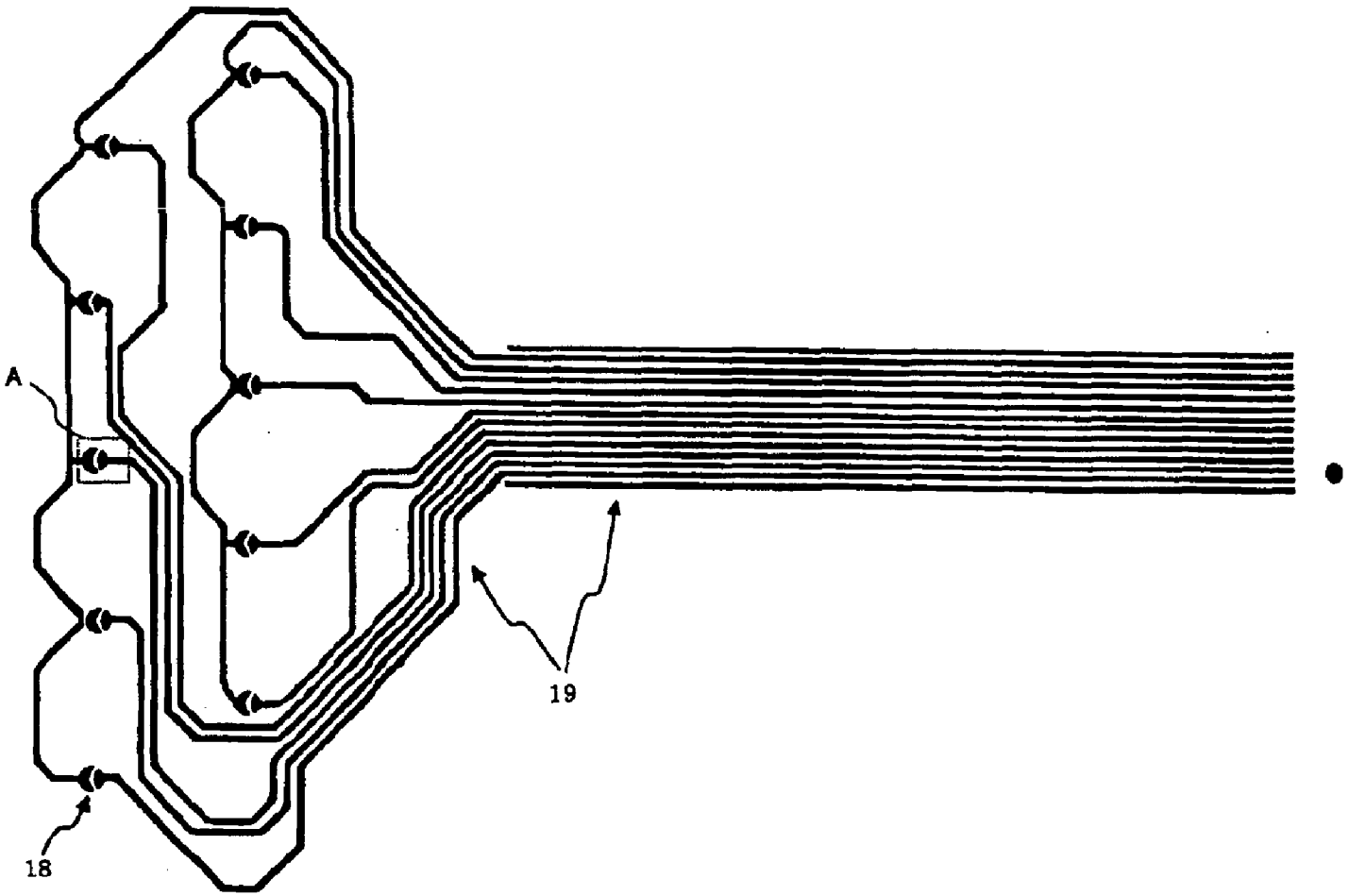
FIG. 2 demonstrates a sample fixed-electrode wiring used to incorporate the invention into a conventional keyboard switch with a rubber cap.

FIG. 2 illustrates an example of a wiring pattern 19 used to electrically connect an assortment of fixed electrodes 18 distributed over the membrane sheet 12 in creating a key pattern for a keyboard. Each fixed electrode 18 is composed of a pair of electrodes in a bridge connection configuration that are paired in a row with the prescribed spacing. Any shape can be employed for the fixed electrodes 18, provided that the shape thereof enables reliable bridge contact with the moveable electrode 22. Especially preferred is a comb-like shape.

As shown in FIG. 1, a support structure comprising the fixed electrode support 13 and the rubber cap support 14 is provided at the lower surface of the membrane sheet 12. The support is preferably made from resin (or a similar material) and may be integrally molded with the membrane sheet 12 or formed as a separate body. When the support structure is formed as a separate body, it may be bonded to the membrane sheet 12 with an adhesive or formed by printing. The support structure is formed to have a very small prescribed thickness (as viewed in the lamination direction). The structure formed by supports 13 and 14 preferably supports the pairs of fixed electrodes 18 and a collar 20 of the rubber cap 15 from below the membrane sheet 12. By being placed between the membrane sheet 12 and the base plate 11, the same supporting structure forms a gap 21(B) communicating via a ventilation hole 23 with the inner space 29(A) of the rubber cap 15. A variety of patterns can be used for the support structure, as shown in FIG. 3.

Small ventilation holes 23 are formed in the membrane sheet 12 in the vicinity of the fixed electrodes 18 (preferably one hole per one pair). A plurality of ventilation holes 23 can be provided in one rubber cap 15 in order to absorb rapid changes in the air flow amount and to obtain good user-feel of pressing the rubber cap 15.

Space 21(B) serves as a space for accommodating the changing air volume. It is linked to the space outside the keyboard switch.

Figure 3:
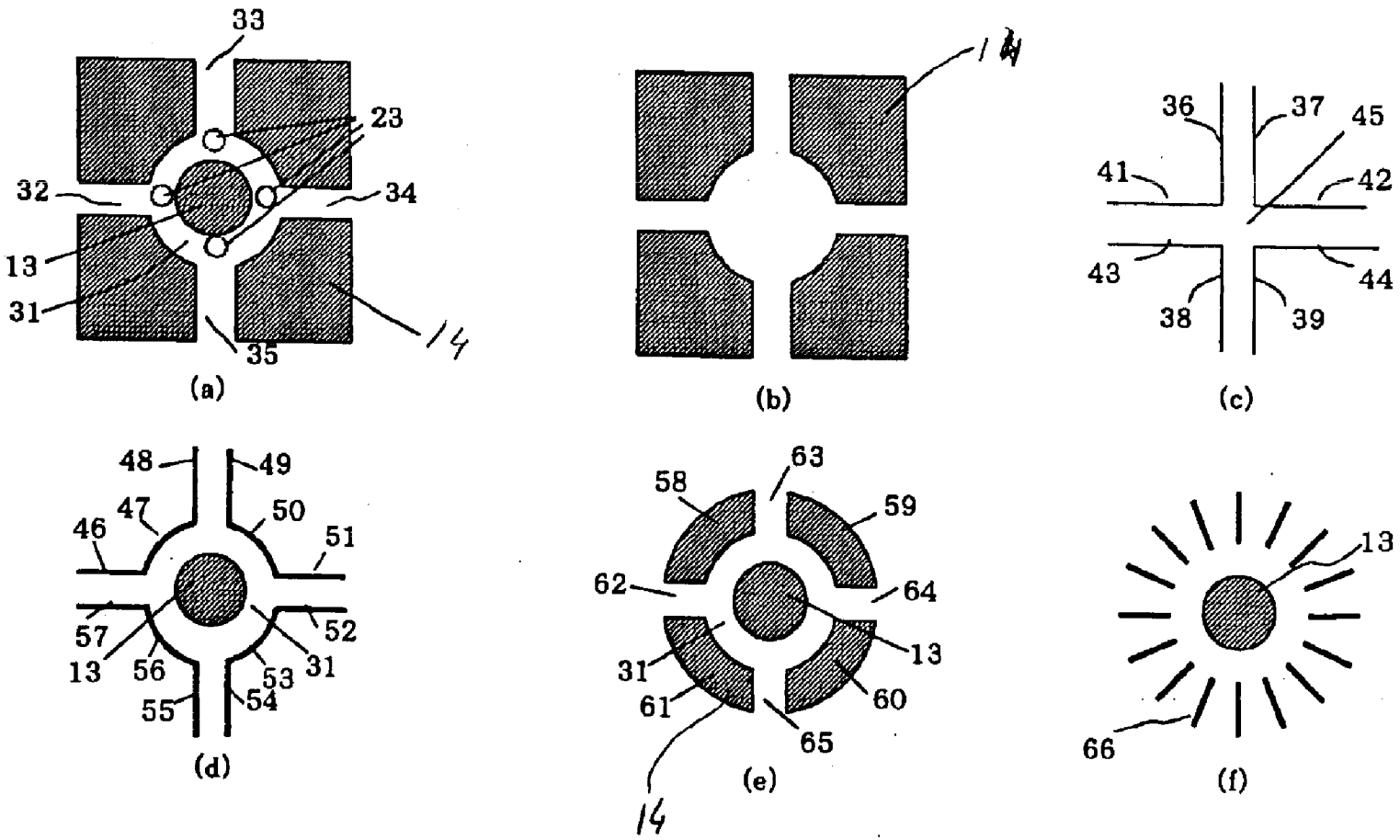
FIG. 3 illustrates various configurations for different embodiments of the fixed-electrode region and protruding member supports.

FIG. 3 illustrates the supports of various types suitable for supporting the protruding member in accordance with the present invention. (Even though the various supports illustrated in FIG. 3 can also be used with other embodiments of the present invention, the explanation will only be conducted with respect to the first embodiment.)

The main purpose of using the supports 13 and 14 is to bear the push-down load when the key top 16 is pushed down. More specifically, they support the fixed electrode 18 to which a load is applied via a movable electrode 22, and the collar 20 to which a load is applied via the skirt portion 24 of the rubber cap 15. Additionally, supports 13 and 14 define boundaries of space 21(B) for accommodating the air or other fluid present inside the rubber cap 15 in the keyboard switch. The supports are formed to a predetermined height above the surface of the membrane sheet 12.

FIG. 3(*a*) shows a type A support in which a round fixed electrode support 13 wider than the round fixed electrode region is formed in the center of a rectangular region. A straight channel 32, 33, 34, 35 is provided in the middle of each side of the rectangular region such that each straight channel extends perpendicularly to the side on which it is formed and to at least two other straight channels. A substantially circular channel 31 surrounds the fixed electrode support 13 and links together central openings of channels 32, 33, 34 and 35, thus forming a cross-like structure centered in the substantially circular channel 31. A through hole 23 is placed at each intersection between channels 32, 33, 34, or 35 and the substantially circular channel 31. Thus, four through holes 23 are formed along the channel 31.

FIG. 3(*b*) shows a type B support in which the fixed electrode support 13 is omitted from the similar shape shown in FIG. 3(*a*).

FIG. 3(*c*) shows a type C support in which cross-like channels are formed by longitudinal linear ribs 36, 37, 38 and 39 and lateral linear ribs 41, 42, 43, and 44 intersecting at 90° angles The fixed electrode support 13 (not shown in FIG. 3(*c*)) is formed within the intersection area 45 where the longitudinal channels formed by linear ribs 36, 37, 38, 39 cross the lateral channels formed by linear ribs 41, 42, 43, 44. A rubber cap support 14 (not shown in FIG. 3(*c*)) may be formed within the radial portion of the shown structure, i.e. within the portion radially distanced from the center of the intersection zone 45 of the cross-like channels. The linear ribs, formed, for example, by multi-layer printing of resin, have a predetermined height and a linear shape in the side view and plane view, respectively.

FIG. 3(*d*) shows a type D support in which the linking channels shown in FIG. 3(*a*) are formed by raised ribs. More specifically, the type D support is configured of straight linear ribs 46, 48, 49, 51, 52, 54, 55, and 57 linked to circular arc-like ribs 47, 50, 53, 56. Raised ribs are preferably being formed by multi-layer printing of resin or by some other similar process. The rubber cap support 14 (not shown in FIG. 3(*d*)) is preferably formed by the circular arc-like ribs 47, 50, 53, and 56 and the straight linear ribs 46, 48, 49, 51, 52, 54, 55, and 57 which preferably have a length somewhat greater than the width of the collar 20 (not shown in FIG. 3(*d*)).

FIG. 3(*e*) shows a type E support in which the rubber cap support 14 is formed by four ring segments 58, 59, 60, and 61. The width of the ring in the radial direction is somewhat larger than the collar width of the rubber cap. The overall shape of the type E support includes the fixed electrode support 13 located in the center of the ring, and the four ring segments 58, 59, 60, and 61 are arranged concentrically around the support 13 such that a substantially circular channel 31 is formed around the support 13. Channels 62, 63, 64, and 65 formed between ring segments 61, 58, 59, and 60 open into the substantially circular channel 31.

FIG. 3(*f*) shows a type F support in which a plurality of straight ribs 66 are arranged in a ring-like pattern where the ribs are radiating away from the center. The channels are formed between the straight ribs. In this structure, the length of ribs 66 is preferably equal to the width of a ring segment shown in FIG. 3(*e*) and is somewhat longer than the collar width of the rubber cap. The rubber cap support 14 thus comprises the radiating straight ribs 66 arranged in the ring-like pattern.

Examples of support configurations shown in FIGS. 3(*a*), 3(*b*), 3(*c*), 3(*e*), and 3(*f*), employ both the fixed electrode support 13 and the rubber cap support 14. Only the support configuration shown in FIG. 3(*d*) represents a specific example in which the fixed electrode support 13 is omitted and the fixed electrode is softly supported by the rubber cap support 14.

In the above-described examples of supports, ventilation holes 23 may be provided around the fixed electrode support 13 in at least four locations corresponding to channel sections, as in the example shown in FIG. 3(*a*). They may also be positioned in a ring-like pattern around the fixed electrode support 13 or along the substantially circular channel 31. Ventilation holes 23 are linked to the space 21(B) with at least four channels. Therefore, the location for providing the ventilation holes can be freely selected in at least four directions even if the key arrangement is somewhat changed. As a result, the problems conventionally associated with the key arrangements can be resolved.

Thus, the presently provided configuration of the support makes it possible to form the channels linking the ventilation holes of the membrane sheet and the space 21(B) located below the membrane sheet in a plurality of different locations. Therefore, channels for sufficient escape of the air can be ensured even if the key arrangement is somewhat changed.

The rubber (or elastic) cap 15, as shown in FIG. 1, is formed from an electrically insulated resin or rubber, such as a silicon rubber, so as to have a cap-like shape (in the form of an edgeless hat or cup). Rubber cap 15 is also formed integrally to have a downward-open cap-like shape having a tubular top portion 71 extending upward from the top portion of the cap. The skirt portion 24 extends downward from the perimeter of the tubular top portion 71, and a thick collar 20 is provided in the extended position at the lower end portion of the skirt portion 24. This rubber cap 15 offers s a push-down projection 72 formed integrally with the top portion on the inner side of the cap so as to protrude downward. A movable electrode 22 composed of an electrically insulating film is preferably formed by printing on the distal end of the push-down projection 72.

The rubber cap 15 is positioned so that the movable electrode 22 and fixed electrode 18 face each other, and the lower surface of the collar 20 is then securely bonded to the upper surface of the membrane sheet 12.

When the rubber cap is driven by being pushed down, the movable electrode 22 is bridge connected to the fixed electrode 18. As for the movable electrode 22, a cylindrical rod-like movable electrode composed of an electrically conductive rubber or the like may be employed instead of the electrically conductive film.

Figure 4:
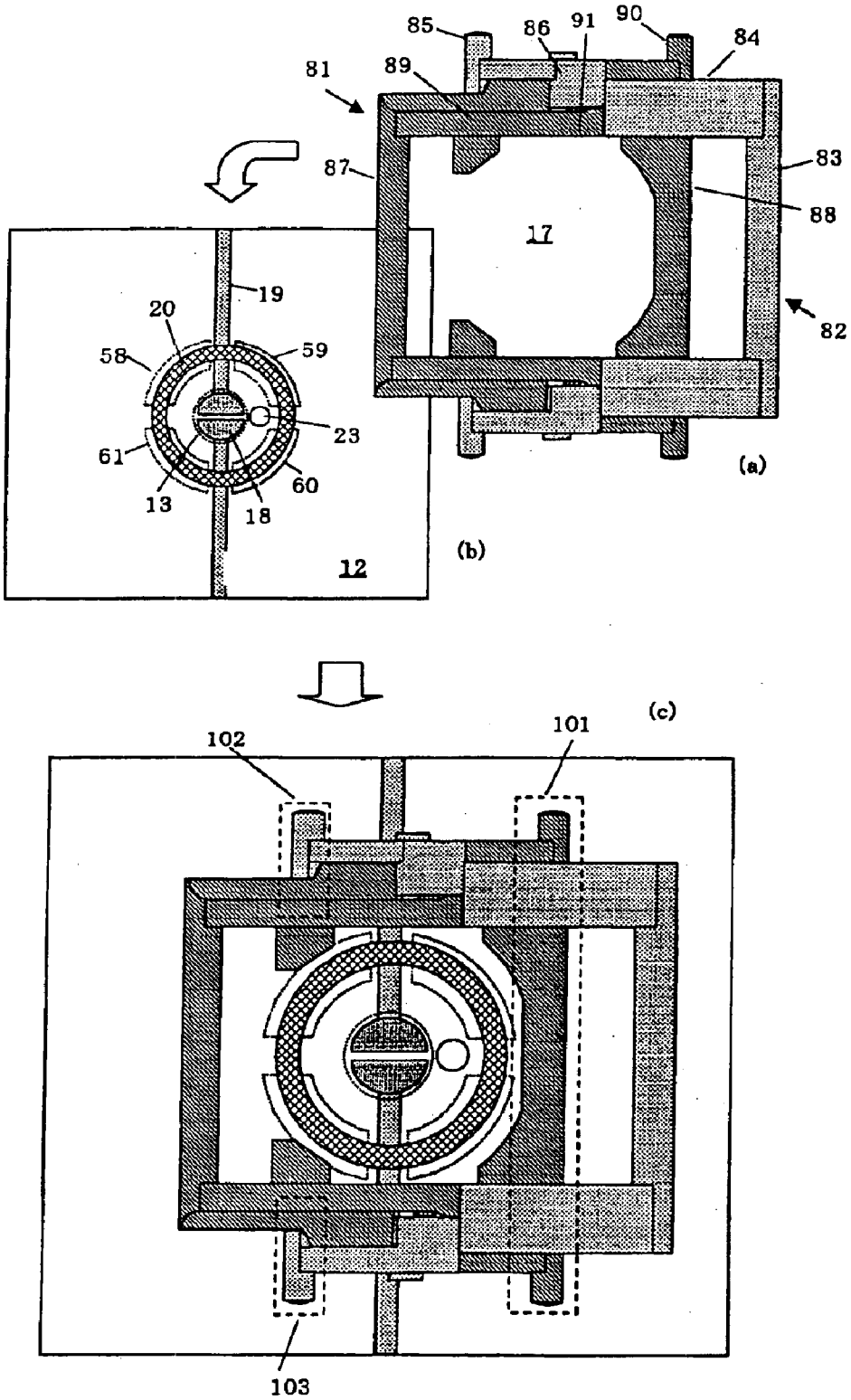
FIG. 4 illustrates the structures in which a guiding and supporting mechanism is incorporated onto a wiring.

FIG. 4 is an explanatory drawing illustrating a structure in which a guiding and supporting mechanism is provided on a wiring pattern. FIG. 4(*a*) is a plane view of the guiding and supporting mechanism. FIG. 4(*b*) shows a wiring pattern arranged around the fixed electrode on the membrane sheet. FIG. 4(*c*) is a plane view of the guiding and supporting mechanism mounted on the wiring pattern. The guiding and supporting mechanism ensures smooth and accurate movement of the key top in the vertical direction.

Figure 5:
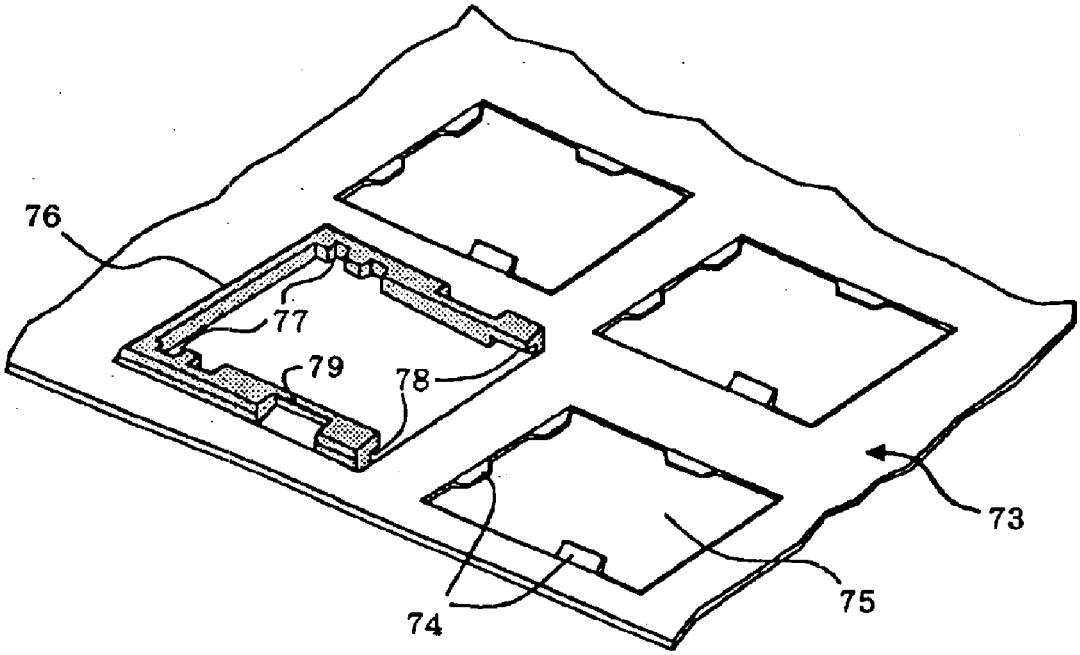
FIG. 5 illustrates a plate-like holder for locking the guiding and supporting mechanism.

FIG. 5 is an explanatory drawing of a plate-like holder for locking the guiding and supporting mechanism.

FIG. 4(*b*) shows the membrane sheet 12, as viewed from the fixed electrode 18 side (surface side); the structural elements located on the back side surface are shown by the dotted lines. The fixed electrode 18, having a pair of electrodes disposed opposite each other, and wiring 19, extending from the fixed electrode 18, are formed on the surface side of the membrane sheet 12. A ventilation hole 23 penetrates through the membrane sheet 12 in the vicinity of the fixed electrode 18. Collar portion 20 of the rubber cap is provided so as to cover the fixed electrode 18 and the ventilation hole 23.

The invention shown in FIG. 4(*b*) utilizes the type E support comprising four ring segments 58, 59, 60, and 61, shown by broken lines and formed so as to expand from the collar portion 20. This support structure is provided on the back side surface of the membrane sheet 12 so as to support the collar portion 20 of the rubber cap. As a result, the fixed electrode 18 is covered over the entire surface area and reliably supported by the fixed electrode support 13. Furthermore, the fixed electrode support 13 is provided over a surface area slightly larger than that of the fixed electrode 18. As a result, the fixed electrode 18 is covered over the entire surface area and is reliably supported with the fixed electrode support 13.

Referring to FIG. 4(*b*), the ventilation hole 23 located in the membrane sheet 12 extends to the substantially circular channel of the support structure on the outer side (as viewed in the radial direction) of the fixed electrode support 13 of the support so as to pass from the front surface to the back side surface of the sheet on the inner side of the inner periphery of the collar portion 20 in the rubber cap.

Although the embodiment of the invention shown in FIG. 4(*b*) utilizes the type E support, other types of supports shown in FIG. 3 may be used with similar advantages. Accordingly, additional explanation thereof is omitted as unnecessary.

The guiding and supporting mechanism 17 shown in FIG. 4(*a*) is constructed by assembling a working frame 81 of an square-like shape, a working arm 82 of an approximately U-like shape and the two shaft portions 86 and 91 connected so as to obtain an approximately X-like shape. The working frame 81 comprises arms 89 having a shaft portion 91 in the intermediate part thereof and a linking beam 87 linked to arms 89 on both sides. Thus arms 89 form two sides of the square-like shape of the frame 81. The frame also includes sliding pins 90 located at both sides of one end of the frame 81. The working frame 82 comprises arms 84 constituting two side portions of the U-like bracket structure, connected to bearing pins 85 at the open side of the bracket structure. Shaft 86 is positioned in the intermediate portion of each arm 84, and a beam 83 links arms 84 at the closed end of the U-shaped structure.

As shown in FIG. 1, a plate-shaped holder 80 is provided on top of the membrane sheet 12 for locking the guiding and supporting mechanism 17. Plate-shaped holder 80 comprises a flat support plate 73 provided with openings 75 and U-shape support frames 76 disposed inside the openings 75, as shown in FIG. 5 and FIG. 1. The support plate 73 is preferably made of a very thin metal sheet and has integrally formed therewith a plurality of raised tabs 74 that rise upward at an angle at the edges of the openings 75. The support frame 76 is positioned and held in a constricted state between the raised tabs 74 and membrane sheet 12 by fitting the raised tabs 74 into fitting grooves 79 on both sides of the support frame 76. The support frame 76 also has a pair of constricting and holding portions 77 formed on the inner side of both side portions of the frame 76 for supporting a pair of bearing pins 85 of the guiding and supporting mechanism 17. Further, sliding steps 78 are formed in the support frame 76 for slidably guiding the pair of sliding pins 90.

FIG. 4(*c*) illustrates a state in which the guiding and supporting mechanism 17 shown in FIG. 4(*a*) was placed on the wiring pattern shown in FIG. 4(*b*). In this embodiment, the guiding and supporting mechanism 17 is placed directly or, if necessary, via a resistant film on the membrane sheet 12 provided with a wiring pattern. Sliding pins 90 of the guiding and supporting mechanism 17 are slidably guided by the sliding steps 78 of the support frame 76 and the membrane sheet 12, as shown in FIG. 1.

In other words, the structure is such that the sliding pins 90 slide over the surface of the membrane sheet 12 where the wiring is located. Similarly, the bearing pins 85 of the guiding and supporting mechanism 17 are rotatably supported by the constricting and holding portions 77 of the support frame shown in FIG. 5 and the membrane sheet 12. In other words, the structure is such that the bearing pins 85 rotate over the surface of the membrane sheet 12 where the wiring is located. Here, as shown by the dotted line regions in FIG. 4(*c*), the contact regions, where the bearing pins 85 and sliding pins 90 are in contact with the membrane sheet 12, are set outside the wiring region. The dotted line regions shown in FIG. 4(*c*) approximately represent the contact regions. These contact regions 101, 102, and 103 are provided preferably outside the region of wiring 19 and outside the region where the collar 20 of the rubber cap is placed. At least the contact region 101, where the sliding pins 90 are disposed, is to be provided outside the region of wiring 19 and outside the region where the collar 20 of the rubber cap is placed. As a result, the guiding and supporting mechanism 17 can be mounted on the membrane sheet 12 directly or via a resistant film, without introducing an insulating sheet.

The key top 16 shown in FIG. 1 is made of a synthetic resin such as an ABS resin, and characters are provided by gravure process or printing on the upper surface thereof. At the lower surface of the key top 16, the holder 25 having a p-like shape shown in the figure is locked with a latch. The guiding and supporting mechanism 17 with an X-like arm structure of working frame 82 and working frame 81 rotatably supported around their central portion is provided between the key top 16 and the holder 25. When the key top 16 is pushed down, the rubber cap 15 can be pressed uniformly in the up-down direction (vertical direction) via the guiding and supporting mechanism 17.

As described above, the guiding and supporting mechanism 17 comprises working frames 81 and 82, and linking beams 83 and 87. The linking beam 83 is guided and supported between the underneath surface of the key top 16 and the latch 26 of the holder 25. The other linking beam 87 is sandwiched between the underneath surface of the key top 16, the stopper 28, and the latch 27 provided at the holder 25.

The operation of the keyboard switch will be explained with respect to FIG. 1. First, when the key top 16 is pushed in the downward direction, the top portion of the rubber cap 15 is pressed down via the guiding and supporting mechanism 17, the skirt portion 24 of the rubber cap 15 deforms and buckles, and this buckling action produces a clicking feel in the rubber cap 15. Accompanying this, the sliding electrode 22 forms a bridge contact with the first and second fixed electrodes 18, the first and second fixed electrodes 18 then become electrically connected, and a switch-on state is assumed. At this time, following the deformation of the rubber cap 15, the air present inside the rubber cap 15 is released through the ventilation hole 23 into the space 21(B) located between the membrane sheet 12 and base plate 11 and is accommodated within this space 21(B) or partially released to the outside space.

In the space 21(B) bounded by the membrane sheet 12 and the base plate 11, the portion outside the fixed electrode support 13 and the rubber cap support 14 that take a surface area region somewhat larger than that where the electrode and the collar portion 20 of the rubber cap 15 are located, serves as a space for absorbing the changing air volume. However, the space 21(B) is also linked to the space outside the keyboard switch. Therefore, it has a much larger capacity than the volume of the elongated hole described in Japanese Published Unexamined Patent Application No. 2002-279854.

For this reason, even when a plurality of key tops 16 are pushed down at the same time, the air present inside the plurality of rubber caps 15 will be released into the space 21(B) through the ventilation holes 23 present inside the respective rubber caps, and fluctuations of air pressure will be absorbed inside the space 21(B). The air present inside the space 21(B) will be further released into the outside space at the head thereof. Thus, when one or a plurality of key tops 16 are pushed down, the air present inside the rubber caps 15 is sufficiently released into the space 21(B) and the outside space through the ventilation holes 23. Therefore, the pleasant buckling user-feel of rubber caps 15 can be maintained.

If the push-down pressure applied to the key top 16 is then released from the switch-on state, the buckled rubber cap 15 will restore the original cap-like shape under the effect of its own elastic forces, the bridge contact state of the pair of fixed electrodes 18 will be switched to OFF, and the key top 16 will be pushed up and returned to the original position.

In this process, the inside of the rubber cap 15 that had a small volume and had a small amount of air therein due to preceding buckling deformation takes up the air from the space 21(B) and the outside space via the ventilation hole 23 and restores the original cap shape. As a result, the space 29(A) bounded by the rubber cap 15 and the membrane sheet 12 and the large-capacity space 21(B) that is linked to the outside space are linked via the ventilation hole 23.

Because spaces 29(A) and 21(B) are linked via the ventilation hole 23, even if a large quantity of air moves under the inversion action of the projection, the fluctuations of air flow can be fully accommodated since the space 21(B) has a large capacity and the linking channels do not have a sealed structure. Furthermore, the space 21(B) is open to the outer space. As a result, a sealed structure that is dustproof and waterproof can be obtained without losing the melodic feel (buckling feel, clicking feel) of the key tops 16.

Additionally, as shown in FIG. 3(*c*), for example, the supports in accordance with the present invention can have at least four channel sections around the fixed electrode support 13. Ventilation holes 23 can be provided within these channels and linked to the sealed space 21(B) along at least four channels. Therefore, even if the key arrangement is somewhat changed, the location for providing the ventilation hole can be freely selected in at least four directions. As a result, the conventional problems associated with key arrangement can be resolved.

Figure 6:
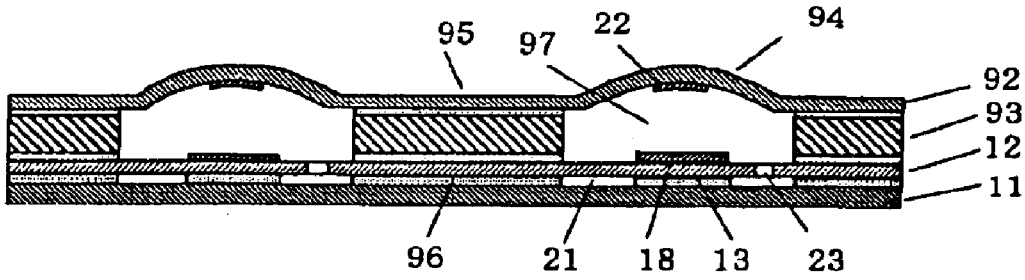
FIG. 6 demonstrates a side-view cutaway of the invention as incorporated into a dome-switch keyboard.

The second embodiment of the present invention, in which the protruding member is composed of a surface sheet comprising a projecting portion and a spacer sheet, will be described below with respect to FIG. 6. FIG. 6 is a cross sectional view of the keyboard switch of the second embodiment of the present invention. A projecting portion 94 executes a return action and an open-close action, a skirt portion 95 and a spacer sheet 93 enable the projecting portion 94 to realize an invertible stroke and also have a function of supporting the projecting portion 94 on the membrane sheet 12. Therefore, from the standpoint of functions, the two components employed in the second embodiment, that is, the front sheet 92, composed of the projecting portion 94 and the skirt portion 95, and the spacer sheet 93 are equivalent to the rubber cap of the first embodiment. Thus, they are included in the same concept of a protruding member.

Because of its shape, the keyboard switch in accordance with the present invention, as shown in FIG. 6, is also called a dome switch. This switch preferably includes the surface sheet 92, spacer sheet 93, membrane sheet 12, and base plate 11. Sheets 92, 93, 12 and base plate 11 are secured with an adhesive. The surface sheet 92 has elasticity and comprises a plurality of projecting portions 94 formed at the predetermined distance from each other via skirt portions 95 serving to support the projecting portions. Each projecting portion 94 is formed to have a dome-like shape that protrudes at the outer surface side and can be inverted at the inner surface side. The movable electrode 22 is provided on the inner surface of each projecting portion 94. The surface sheet 92 is a sheet-like member preferably made from a synthetic resin such as polyethylene terephthalate (PET), and projecting portions can be formed therein by hot pressing. The electrode is formed by printing from carbon or through some other similar process.

The spacer sheet 93 is a flexible sheet-like member preferably made from a resin such as polyethylene terephthalate (PET), and functions as a member for ensuring the stroke size of the projecting portion 94. A plurality of fixed electrodes 18 and wiring 19 are provided on the membrane sheet 12 composed of a flexible printed circuit (FPC) or the like, and having a ventilation through hole 23 provided in the vicinity of the fixed electrode 18.

Fixed electrode support 13 is provided opposing the fixed electrode 18 between the membrane sheet 12 and the base plate 11. The protruding member support 96 is provided to match the skirt portion 95 and the compatible spacer sheet 93.

The membrane sheet 12 and the base plate 11 are constructed with tight seal (except for the ventilation hole 23) by a switch case not shown. As a result, the space 97, bounded by the surface sheet 92, spacer sheet 93, and membrane sheet 12; and the large-volume space 21(B), bounded by the membrane sheet 12, base plate 11, protruding member support 96 provided with a linking channel, and fixed electrode support 13, are linked via the ventilation hole 23. The protruding member support 96 has a structure identical to that of the rubber cap support in the first embodiment illustrated by FIG. 3.

Because the space 97 and the large-volume space 21(B) are linked via the ventilation hole 23, even if a large amount of air is moved by the inversion action of the projecting portion 94 the fluctuations of flow rate can be sufficiently accommodated because space 21(B) has an adequately large capacity. Furthermore, because space 21(B) is open to the outside space, the movement of air is greatly facilitated. As a result, a sealed structure that is dustproof and waterproof can be obtained without losing the melodic feel (buckling feel, clicking feel) of the key tops.

Figure 7:
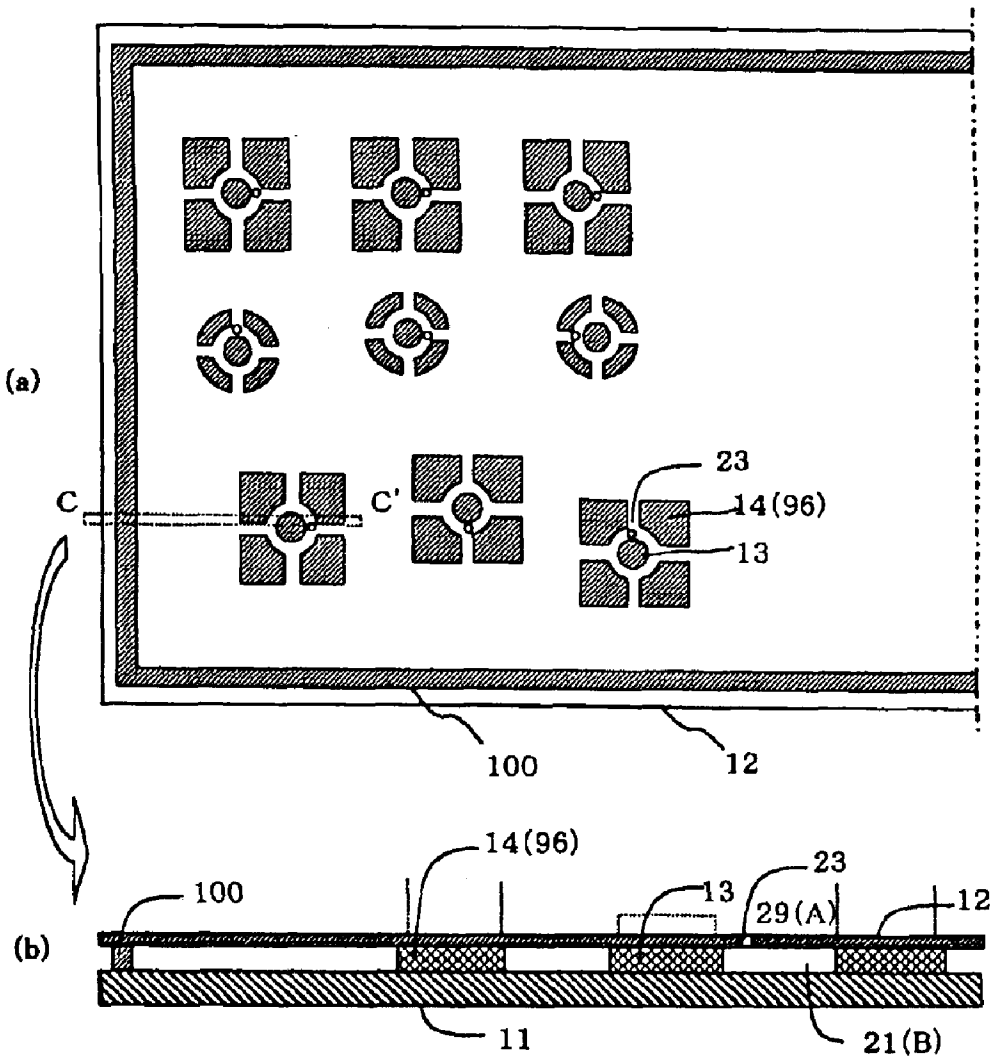
FIG. 7 illustrates a fixed-electrode wiring used to incorporate the invention into a dome-switch keyboard.
Figure 8:
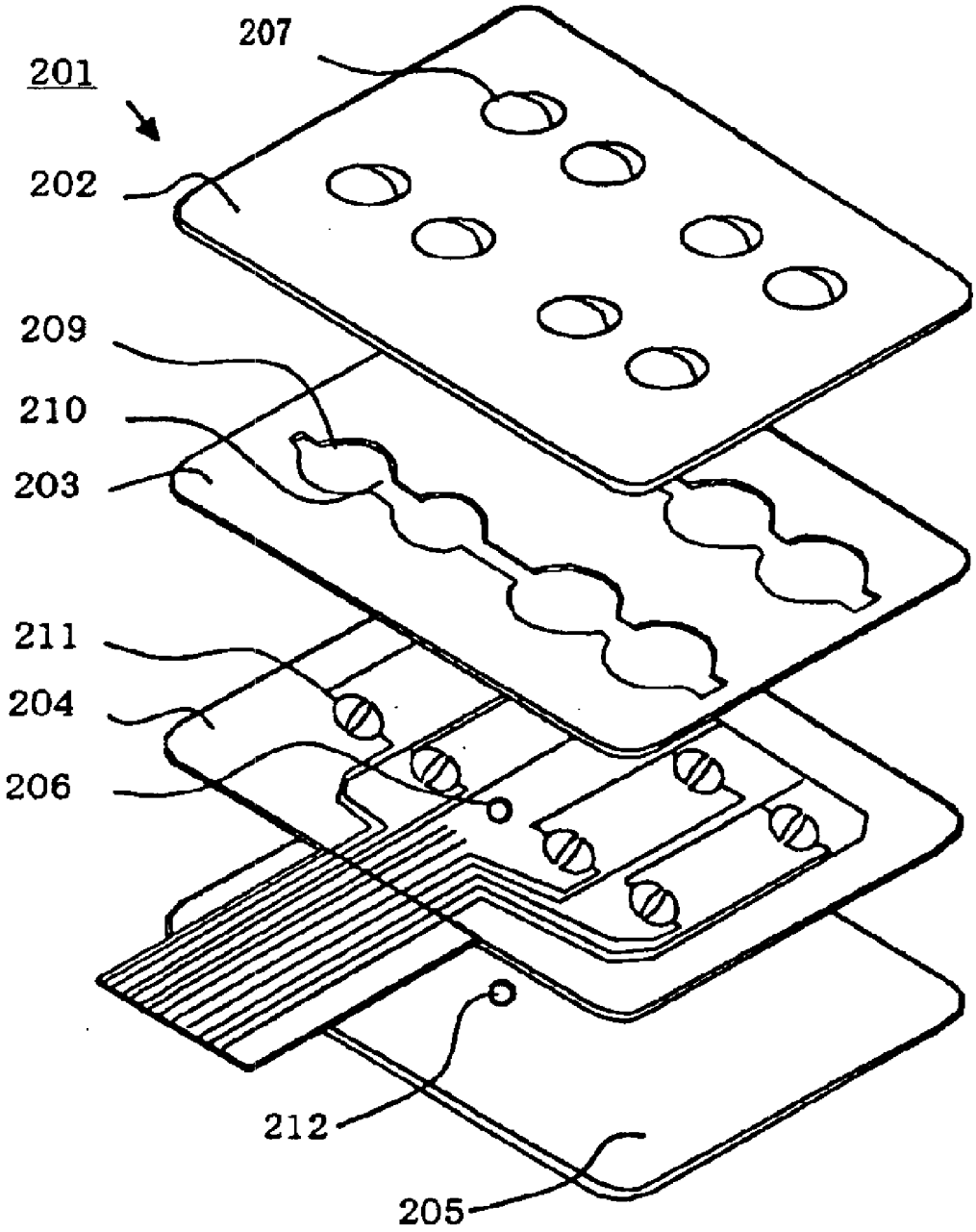
FIG. 8 provides an expanded view of the laminate layers used to incorporate the invention into a dome switch keyboard.
Figure 9:
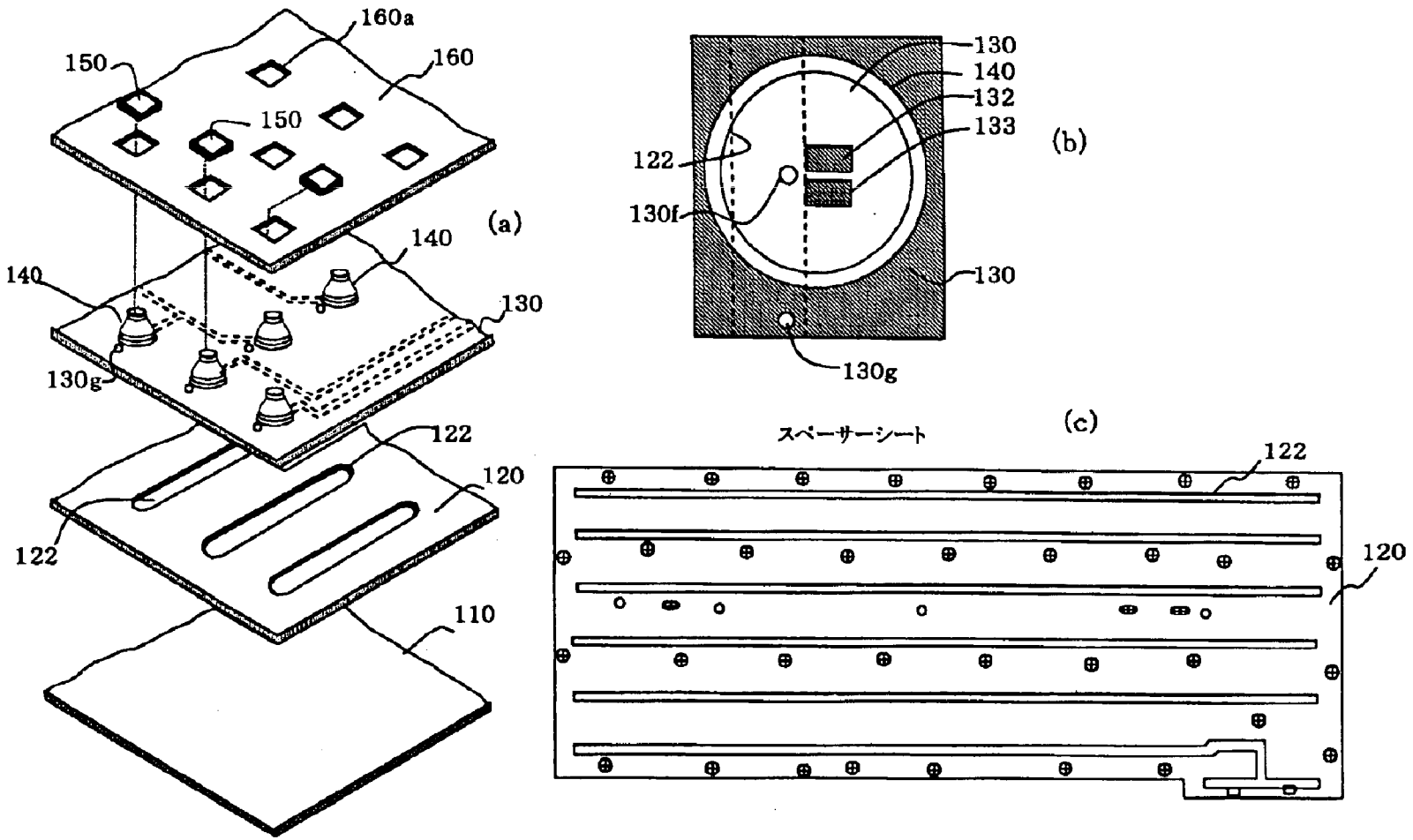
FIG. 9 provides a structural view of the keyboard switch using a conventional rubber cap.
Figure 10:
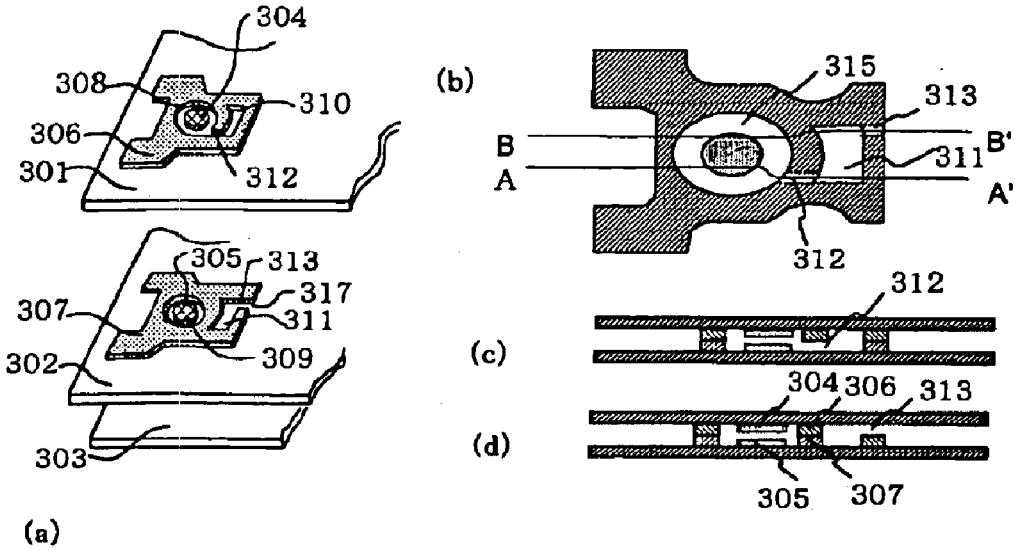
FIG. 10 provides a structural view of the conventional membrane-type keyboard.
Figure 11:
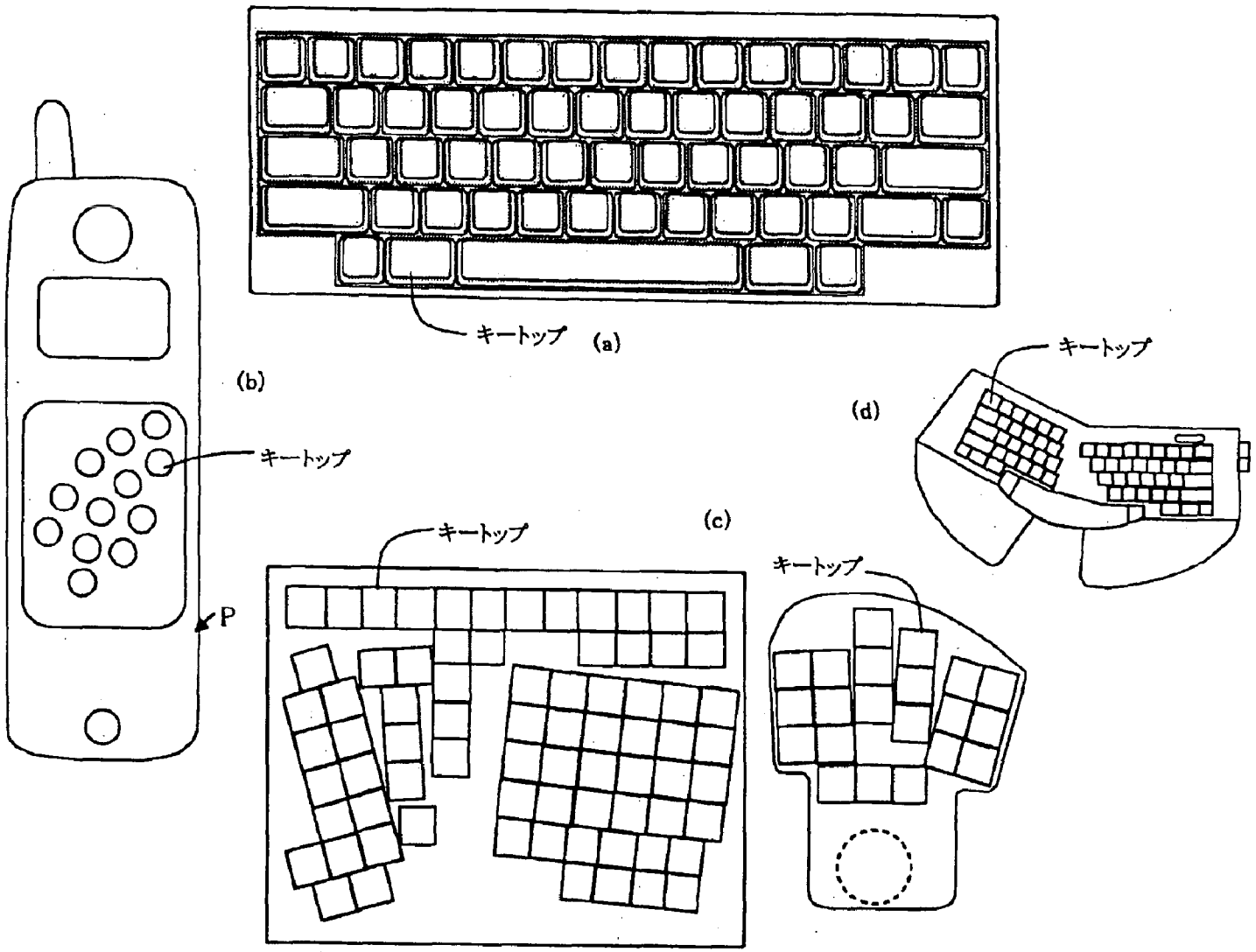
FIG. 11 illustrates the conventional key arrangement for a variety of keyboard applications.

FIG. 7, a structural view of the third embodiment of the present invention, provides a lower surface view of the membrane sheet (plane view of the back side surface). FIG. 7(*b*) is a cross-sectional view of a rectangular region (represented by dotted lines) shown by C–C' in FIG. 7(*a*), which is a cross-sectional view of the space from the back side surface of the membrane sheet (structural components located on the front surface side are omitted) to the base plate.

In the third embodiment shown in FIG. 7, the structure from the membrane sheet to the base plate that was employed in the first embodiment and second embodiment is a completely sealed structure, except for the ventilation hole. A partition wall 100 surrounding the surface of the membrane sheet 12 and base plate 11 is provided at either of the opposing surfaces thereof, and a sealed space having no holes except for the ventilation hole 23 is bounded by the membrane sheet 12, base plate 11, and partition wall 100.

In the structure shown in FIGS. 7(*a*) and 7(*b*), a plurality of electrode supports 13 and protruding member supports 96 or rubber cap supports 14 are provided on the back side surface of the membrane sheet 12, and the partition wall 100 which continuously surrounds the back side surface is provided so as to surround those components. The partition wall 100 is formed as a multilayer coating layer or adhesive layer mainly composed of a resin material so as to have the predetermined height, or as an antenna layer for wireless communication from an electrically conductive material such as electrically conductive ink. The partition wall 100 can have any shape in the plane view thereof, provided that it can surround the electrode support, protruding member support, and rubber cap support.

The large-volume space 21(B) bounded by the membrane sheet 12, base plate 11, and partition wall 100 is linked to the space 29(A) bounded by the rubber cap and membrane sheet 12, for example, only by the ventilation hole 23. As a result, a sealed space can be composed by the two spaces.

The effect of the present invention is described hereinbelow in greater detail. Because the space 29(A), bounded by the rubber cap and membrane sheet, and the large-volume space 21(B), bounded by the membrane sheet, base plate, protruding member support provided with a linking channel, and fixed electrode support, are linked via the ventilation hole; even if a large amount of air is moved by the inversion action of the projecting portion, the fluctuations in flow rate can be sufficiently absorbed because the space 21(B) has a large capacity and is linked to the outside. As a result, a sealed structure that is dustproof and waterproof can be obtained without losing the melodic feel (buckling feel, clicking feel) of the key tops. Furthermore, if a partition wall surrounding the surface of the membrane sheet and base plate is provided at either of the opposing surfaces thereof, it is possible to obtain a sealed space having no holes except for the ventilation hole, this sealed space being bounded by the membrane sheet, base plate, and partition wall.

As described above, the support structure can have at least four channel sections surrounding the fixed electrode support 13. Additionally, a ring-shaped ventilation hole 23 can be provided in the vicinity of the four channels and linked to the sealed space 29(A) with at least four channels. Therefore, even if the key arrangement is somewhat changed, the location for providing the ventilation hole can be freely selected in at least four directions. As a result, the problems conventionally associated with key arrangement can be resolved. In other words, the supports are constructed so that the channels linked to the space 21(B) below the membrane sheet and the ventilation hole of the membrane sheet can be provided in a plurality of different locations. Channels can be selected such that the air can sufficiently escape even if the key arrangement is somewhat changed.

For the convenience of the reader, the above description has focused on a representative sample of all possible embodiments, a sample that teaches the principles of the invention and conveys the best mode contemplated for carrying it out. The description has not attempted to exhaustively enumerate all possible variations. Other undescribed variations or modifications may be possible. For example, where multiple alternative embodiments are described, in many cases it will be possible to combine elements of different embodiments, or to combine elements of the embodiments described here with other modifications or variations that are not expressly described. Many of those undescribed variations, modifications and variations are within the literal scope of the following claims, and others are equivalent.

What is claimed is:

1. An keyboard switch, comprising:

a membrane sheet having an upper surface and a lower surface;

at least one fixed electrode positioned on said upper surface of said membrane sheet;

a protruding member affixed to said upper surface of said membrane sheet, said protruding member being selectively movable;

at least one movable electrode secured inside said protruding member such that when said protruding member is moved toward said membrane sheet, said movable electrode contacting said at least one fixed electrode;

a base plate situated below said membrane sheet such that a gap is formed between said base plate and said membrane sheet;

a support structure secured within said gap and positioned to support said fixed electrode and said protruding member; and a ventilation opening penetrating said membrane sheet and positioned inside said protruding member in the vicinity of said fixed electrode;

wherein said protruding member and said upper surface of said membrane sheet define a first air space, wherein said lower surface of said membrane sheet, said support structure and said base plate define a second air space, and wherein said first air space is connected to said second air space through said ventilation opening such that all air escaping from said first air space is accommodated within said second air space.

2. The keyboard switch of claim 1, wherein said protruding member is a flexible cap.

3. The keyboard switch according to claim 2, wherein said support structure further comprises a substantially circular fixed electrode support surrounded by an annular linking channel, and wherein said ventilation opening can be disposed in a plurality of places around the fixed electrode support.

4. The keyboard switch of claim 3, wherein said supporting structure further comprises a peripheral support surrounding said substantially circular fixed electrode support, and wherein at least four mutually perpendicular linking channels are formed within said peripheral support such that each of said perpendicular linking channels opens into said annular linking channel.

5. The keyboard switch of claim 3, wherein said supporting structure further comprises a substantially circular peripheral support surrounding said substantially circular fixed electrode support, and wherein at least four mutually perpendicular linking channels are formed within said peripheral support such that each of said perpendicular linking channels opens into said annular linking channel.

6. The keyboard switch of claim 3, wherein said supporting structure further comprises a ring-like peripheral support surrounding said substantially circular fixed electrode support, said peripheral support comprising a plurality of linear ribs having a plurality of straight linking channels formed between said linear ribs such that each of said straight linking channels opens into said annular linking channel.

7. The keyboard switch according to claim 2, wherein said support structure further comprises a peripheral support having an annular linking channel and at least four mutually perpendicular linking channels formed within said peripheral support such that each of said perpendicular linking channels opens into said annular linking channel, and wherein said ventilation opening can be disposed in a plurality of places along said annular linking channel.

8. The keyboard switch of claim 1, wherein the protruding member is a dome-like projection having an inversion characteristic.

9. The keyboard switch according to claim 8, wherein said support structure further comprises a substantially circular fixed electrode support surrounded by an annular linking channel, and wherein said ventilation opening can be disposed in a plurality of places around the fixed electrode support.

10. The keyboard switch of claim 9, wherein said supporting structure further comprises a peripheral support surrounding said substantially circular fixed electrode support, and wherein at least four mutually perpendicular linking channels are formed within said peripheral support such that each of said perpendicular linking channels opens into said annular linking channel.

11. The keyboard switch of claim 9, wherein said supporting structure further comprises a substantially circular peripheral support surrounding said substantially circular fixed electrode support, and wherein at least four mutually perpendicular linking channels are formed within said peripheral support such that each of said perpendicular linking channels opens into said annular linking channel.

12. The keyboard switch of claim 9, wherein said supporting structure further comprises a ring-like peripheral support surrounding said substantially circular fixed electrode support, said peripheral support comprising a plurality of linear ribs having a plurality of straight linking channels formed between said linear ribs such that each of said straight linking channels opens into said annular linking channel.

13. The keyboard switch according to claim 8, wherein said support structure further comprises a peripheral support having an annular linking channel and at least four mutually perpendicular linking channels formed within said peripheral support such that each of said perpendicular linking channels opens into said annular linking channel, and wherein said ventilation opening can be disposed in a plurality of places along said annular linking channel.

14. The keyboard switch of claim 1, wherein said ventilation opening is connected to said second air space via at least one linking channel formed in said support structure.

15. The keyboard switch according to claim 14, wherein said support structure further comprises a substantially circular fixed electrode support surrounded by an annular linking channel.

16. The keyboard switch of claim 15, wherein said ventilation opening can be disposed in a plurality of places around the fixed electrode support.

17. The keyboard switch of claim 15, wherein said supporting structure further comprises a peripheral support surrounding said substantially circular fixed electrode support, and wherein at least four mutually perpendicular linking channels are formed within said peripheral support such that each of said perpendicular linking channels opens into said annular linking channel.

18. The keyboard switch of claim 15, wherein said supporting structure further comprises a substantially circular peripheral support surrounding said substantially circular fixed electrode support, and wherein at least four mutually perpendicular linking channels are formed within said peripheral support such that each of said perpendicular linking channels opens into said annular linking channel.

19. The keyboard switch of claim 15, wherein said supporting structure further comprises a ring-like peripheral support surrounding said substantially circular fixed electrode support, said peripheral support comprising a plurality of linear ribs having a plurality of straight linking channels formed between said linear ribs such that each of said straight linking channels opens into said annular linking channel.

20. The keyboard switch according to claim 14, wherein said support structure further comprises a peripheral support having an annular linking channel and at least four mutually perpendicular linking channels formed within said peripheral support such that each of said perpendicular linking channels opens into said annular linking channel.

* * * * *